US005920638A

United States Patent [19]

Tsai

[11] Patent Number: 5,920,638

[45] Date of Patent: Jul. 6, 1999

[54] STRUCTURE OF SPEAKER

[76] Inventor: Jung-Kuo Tsai, 2F., No. 39, Alley 46, Lane 52, Sec., 3, Chin Cheng Rd., Tu Cheng, Taipei Hsien, Taiwan

[21] Appl. No.: 08/907,631

[22] Filed: Aug. 8, 1997

[30] Foreign Application Priority Data

Dec. 3, 1996 [TW] Taiwan ..... 85218678

[51] Int. Cl.[6] ..... H04R 25/00

[52] U.S. Cl. ..... 381/397; 381/405; 381/424

[58] Field of Search ..... 381/192, 194, 381/199, 197, 202, 204, 164, 165, 184, 186, 396, 297, 405, 423, 424, 430, 431, 432, FOR 152, FOR 157, FOR 162, FOR 164

[56] References Cited

U.S. PATENT DOCUMENTS 2,261,111 11/1941 Engholm ..... 381/197

*Primary Examiner*—Huyen Le

*Attorney, Agent, or Firm*—Birch, Stewart, Kolasch & Birch, LLP

[57] ABSTRACT

The present invention relates to a structure of speaker which includes a disk body directly connected to the opening of a sound coil in a speaker. The disk body has a couple of reinforcing heat-sinking rings, and the opening edge of disk body is connected with the belly plate of speaker. The speaker of such structure is effective to radiate heat produced from the sound coil through the direct connection of the disk body with the sound coil and due to the light-weighted and thin metallic disk body having effective heat radiation so as to prolong the duration of play as well as the life span of the speaker. The end of the disk body projecting in the sound coil and the other end connected to the belly plate increases the capacity of resistance of the vibration wave and therefore one single speaker may provide an output as a tweeter and a woofer. The disk body directly connecting to the sound coil may give high fidelity of the vibration wave arising from movement of sound coil so as to improve sound quality.

4 Claims, 2 Drawing Sheets

STRUCTURE OF SPEAKER

BACKGROUND OF THE INVENTION

The present invention relates to a structure of speaker which includes a metallic disk body connected to a sound coil with its center. The disk body radiates heat produced from vibration of speakers effectively so as to obtained increased working hours and better sound quality.

The quality of a sound system can be ascertained by listening to the sound effect of a host unit, amplifier and speaker. A speaker plays a key role in a sound system for it is the sound transmitter of the entire sound system and the sound source directly contacted by the user's ears. Therefore, a pair of quality speakers can be much more expensive than the price of other sound systems and that's why the speaker is so valuable and important.

A speaker converts electric oscillation into voice/sound waves for transmitting voice/sound to the user's ears. Referring to FIG. 1, the speaker 1 comprises a sound coil 11 winding with coil 10 where the sound coil is mounted in a magnetic seat 12. When electric power is connected to the coil 10, the coil 10 will produce magnetism to form a repulsive effect with the seat 12 to cause the sound coil 11 to move laterally on the intermediate shaft 120 of the seat 12 and such movement will drive the belly plate 13 in connection with the sound coil. This source of a vibration wave causes a change of a sound wave in the air when the belly plate 13 is reciprocally driven by the sound coil 11, and that is why we can hear the voice/sound transmitted from the speaker.

Referring to FIG. 1, we may know the action of speaker is achieved through reciprocal movement of sound coil 11 driving the belly plate 13, and therefore the sound coil 11 will continue to move in the intermediate shaft 120 of the seat 12. There has been little difference of inside/outside diameter between the sound coil 11 and intermediate shaft 120, i.e. the inside diameter of sound coil 11 is little greater than the outside diameter of the intermediate shaft 120. With such a condition, it is impossible for impurities to appear between the inside diameter of sound coil and the outside diameter of the intermediate shaft of the seat. To prevent the intrusion of dust from the sound coil, the conventional speaker has a cone to cover the joint between the sound coil 11 and belly plate 13, which is also known as a dust cover 14 sticking to the surface of belly plate 13 for covering the opening of the sound coil so as to prevent dust from intruding.

The conventional art of using dust cover to prevent the speaker from intrusion by impurity is not a bad idea but actually it provides some obstacle to the performance of a speaker and even to the technical breakthrough of speaker. The defects lie in the following:

1. The dust cover is made from compacted paper and its cover position is located on the belly plate without direct communication with sound coil; therefore high temperature caused by reciprocal movement of sound coil can not be radiated.
2. High temperature caused by improper location of the dust cover relative to the sound coil will result in the surrounding coil of sound coil burning down and therefore, shorten life span of the speaker.
3. Because the sound coil can not effectively radiate heat unsmooth movement will result in distortion of the sound wave released by the speaker to deteriorate performance and sound quality.

4. When the dust cover sticks to the belly plate without direct connection with the sound coil, the speaker can not deliver heat from the sound coil and this will also reduce the resistance of speaker to vibration. Therefore, the conventional speaker should require another independent speaker because one single speaker can not fully demonstrate tweeter and woofer sound qualities for there is a great difference of sound wave vibration between a tweeter and a woofer.
5. The defect arising from a tweeter and a woofer which cannot be fully demonstrated by one single speaker will result in increasing the consumer's budget and more trouble with the performance of the tweeter where reduced quality lies in improper location and material of dust cover.

The aforesaid defects relating to the conventional speaker have caused severe trouble to users; the speaker is often found burning down or breaking down due to vibration in poolhalls, dancing pubs and areas having singing performances because continuous play is required for a long time. Some sound system users also feel troubled because of failing to enjoy higher quality of sound.

SUMMARY OF THE INVENTION

It is, therefore an object of the present invention to provide a dust cover made from metallic material with good heat radiation to improve sound quality.

Another object of the present invention is to provide a disk body directly connected with the sound coil to radiate the heat effectively so as to prolong the life span of the speaker.

These and other objects and advantages of the present invention will become apparent to those skilled in the art after considering the following detailed specification together with the accompanying drawings.

DETAILED DESCRIPTION OF THE PREFERRED EMBODIMENT

Figure 2:
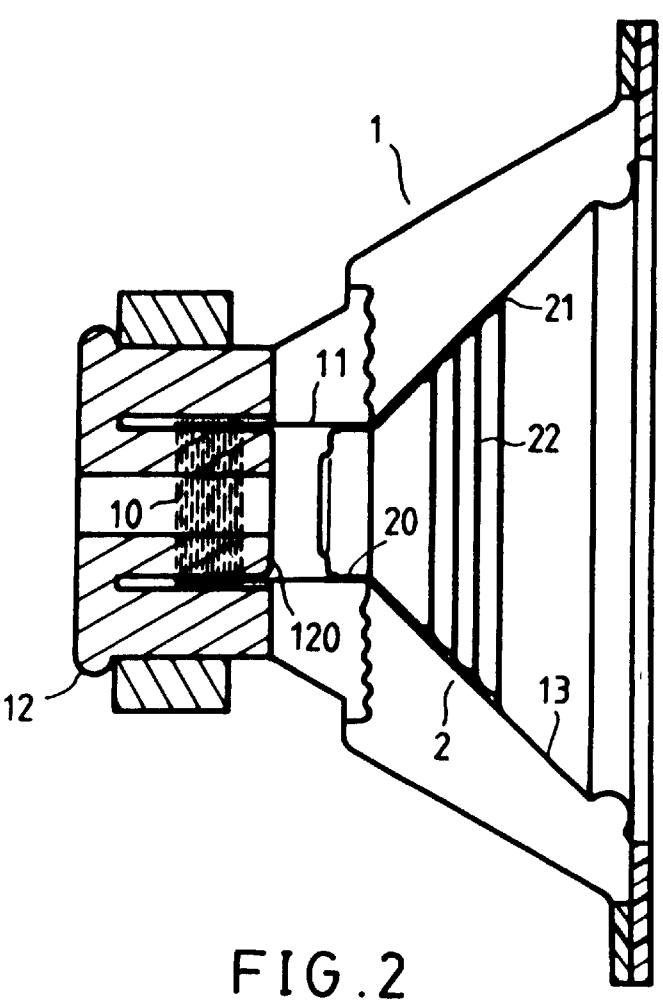
FIG. 2 is a perspective view of the present invention.
Figure 1:
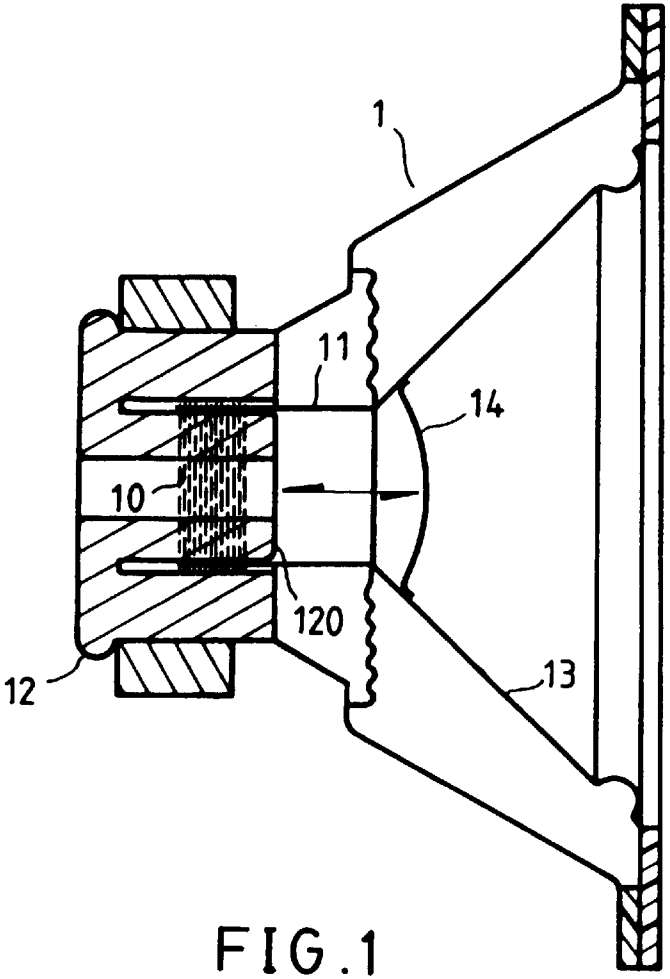
FIG. 1 (PRIOR ART)
FIG. 1 is a perspective view of the conventional speaker.
Figure 4:
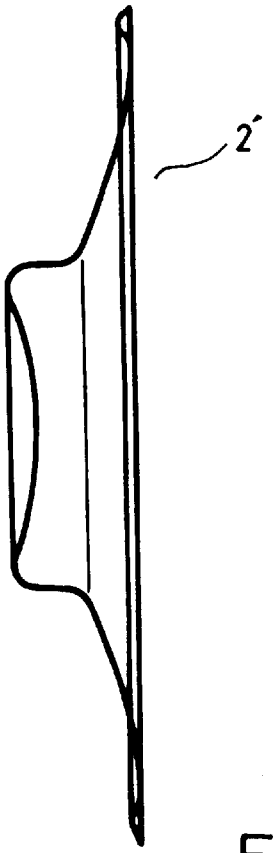
FIG. 4 is a perspective view of the disk body in another type.
Figure 3:
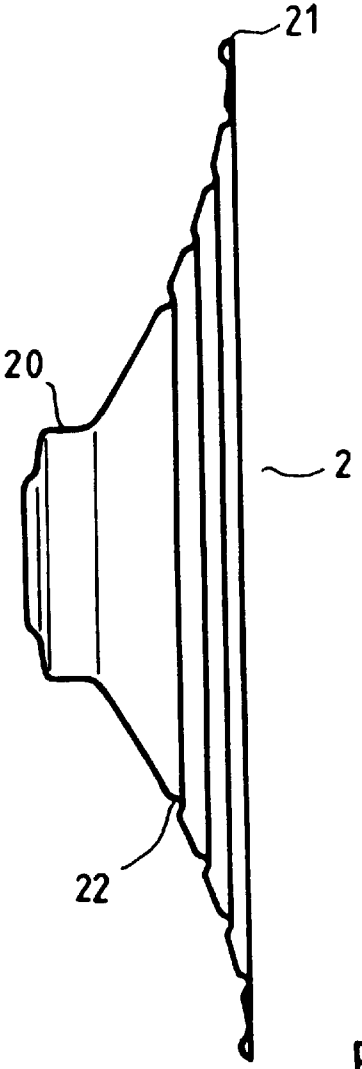
FIG. 3 is a perspective view of the disk body of the present invention.

Referring to FIGS. 1 and 2, the present invention comprises a thin disk body 2 directly mounted in and sticking to the opening part of sound coil 11 with its bottom edge 20 so as to prevent dust from falling into the sound coil 11 and intermediate shaft 120 of the seat, and another opening edge 21 of disk body 2 2 sticks to the belly plate 13 of speaker. The outlook of the sound coil 11 with the bottom edge directly mounted in the disk body 2 is shown in FIG. 3, and the recessed disk body has a bottom edge 20 and there are a couple of reinforced heat-sinking rings 22 on the disk. Referring to FIG. 3, the disk body 2 is usually used for the speaker with a higher output to strengthen heat sinking rate of reinforced heat-sinking ring 22 on the sound coil. The speaker with lower power output may also use the disk body shown on FIG. 4, where the disk body 2 does not have reinforced heat-sinking rings. However, in each embodiment the disk body is made from a light-weighted and thin metal which has better heat radiating characteristics than that of the conventional paper-made dust cover.

Referring to FIG. 2, the reasons for the advantages of the present invention lie in the following:

1. The body being directly connected to the opening of the sound coiled is effective for radiating heat from the sound coil to the air so that the present invention can provide better heat radiation.

2. The disk body directly contacting the sound coil may directly transmit a vibration wave resulting from the movement of the sound coil to produce better sound quality.

3. The disk body being directly connected to the sound coil and being made from rigid, light-weighted and thin metal may increase its vibration-resistant strength and may transmit vibration wave as a woofer or tweeter; therefore, one single speaker may give play effect as a tweeter and a woofer, which can not be made by the conventional woofer or tweeter speaker.

The present invention is a speaker structure with durability and high sound effect which is proven better than the conventional speaker according to an actual product test; such as play hour. The sound coil of the conventional speaker with 100 W output, if continued to play for 40 hours, will burn down but the sound coil of the present invention remains good after continued play of 120 hours with the identical power output. With respect to sound effects, after continued play for 20 hours, the sound coil of the conventional speaker will become hot and difficult to move and result in distortion but the present invention may retain excellent performance with respect to sound effects. Furthermore, the present invention may permit a speaker to give sound effects as a woofer and a tweeter.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A speaker structure comprising:

a disk body made from a relatively light weight and thin metal, said disk body including a first closed concave end and a second open end;

a sound coil structure including a cylindrical support with a coil mounted on an external surface thereof, said closed concave end being disposed within said cylindrical support and contacting said cylindrical support, said closed concave end substantially preventing external environmental elements from contacting said coil structure while said disk body transfers vibration from said sound coil to substantially increase sound quality of said speaker structure;

a belly plate connected to said cylindrical support and the second end of the disk; and means for radiating heat from the sound coil structure disposed on said disk body, said means for radiating heat substantially reducing heat within and adjacent to said sound coil structure which in turn substantially increases life of said speaker structure wherein said means for radiating heat includes a plurality of reinforced heat-sink rings.

2. The speaker structure of claim 1, wherein said heat-sink rings are disposed between said first and second ends of said disk body.

3. The speaker structure of claim 1, wherein said heat-sink rings are disposed within said belly plate.

4. The speaker structure of claim 1, wherein one of said heat-sink rings forms a portion of said second open end.

* * * * *